US007018976B2

(12) United States Patent
Murphy et al.

(10) Patent No.: US 7,018,976 B2
(45) Date of Patent: Mar. 28, 2006

(54) FABRIC TREATMENT ARTICLE AND METHOD

(75) Inventors: Dennis Stephen Murphy, Wyckoff, NJ (US); Michael Orchowski, East Rutherford, NJ (US); Daniel Joseph Fox, Tenafly, NJ (US); Jeanette Ashley, Verona, NJ (US); Nancy Ann Falk, Livingston, NJ (US)

(73) Assignee: Unilever Home & Personal Care USA, divison of Conopco, Inc., Greenwich, CT (US)

( * ) Notice: Subject to any disclaimer, the term of this patent is extended or adjusted under 35 U.S.C. 154(b) by 237 days.

(21) Appl. No.: 10/424,179

(22) Filed: Apr. 25, 2003

(65) Prior Publication Data

US 2004/0214744 A1 Oct. 28, 2004

(51) Int. Cl.
*C11D 17/00* (2006.01)

(52) U.S. Cl. ..... 510/520; 604/378

(58) Field of Classification Search ..... 510/520; 604/365, 367, 370, 371, 372, 373, 374, 378, 604/381

See application file for complete search history.

(56) References Cited

U.S. PATENT DOCUMENTS 3,901,236 A * 8/1975 Assarsson et al. ..... 604/368
4,804,378 A * 2/1989 Shiba et al. ..... 604/367
5,062,973 A 11/1991 Kellett
5,173,200 A 12/1992 Kellett
5,238,587 A 8/1993 Smith et al.
5,547,476 A 8/1996 Siklosi et al.
5,591,236 A 1/1997 Roetker
5,630,847 A 5/1997 Roetker
5,630,848 A 5/1997 Young et al.
5,632,780 A 5/1997 Siklosi
5,658,651 A 8/1997 Smith et al.
5,681,355 A 10/1997 Davis et al.
5,687,591 A 11/1997 Siklosi et al.
5,804,548 A 9/1998 Davis
5,876,462 A 3/1999 Weller et al.
5,942,484 A 8/1999 Roetker et al.
5,965,504 A 10/1999 Reynolds
6,024,767 A 2/2000 Telesca et al.
6,033,729 A 3/2000 Lindauer et al.
6,179,880 B1 1/2001 Smith
6,238,736 B1 5/2001 Smith et al.
6,243,969 B1 6/2001 Yeazell
6,254,932 B1 7/2001 Smith et al.
6,262,009 B1 7/2001 Rogers et al.
6,297,210 B1 10/2001 Hsu et al.
6,315,800 B1 11/2001 Gomes et al.
6,352,969 B1 3/2002 Hsu et al.
6,369,292 B1 * 4/2002 Strack et al. ..... 604/370
6,500,444 B1 12/2002 Ferenc et al.
6,685,686 B1 * 2/2004 Hermansson et al. . 604/385.101
6,838,591 B1 * 1/2005 Waksmundzki et al. .... 604/382

FOREIGN PATENT DOCUMENTS

WO 99/19452 4/1999
WO 00/41736 7/2000

* cited by examiner

*Primary Examiner*—John R. Hardee
(74) *Attorney, Agent, or Firm*—Alan A. Bornstein

(57) ABSTRACT

A fabric treatment article for use in a conventional home clothes dryer is described that deodorizes and freshens clothing in need of freshening without imparting additional stains. The product is particularly suited for delivering a fragrance to relatively dry clothing and can be added directly to the dryer without the need for a bag to contain the product and clothing during the dryer cycle.

10 Claims, 3 Drawing Sheets

FIG. 1
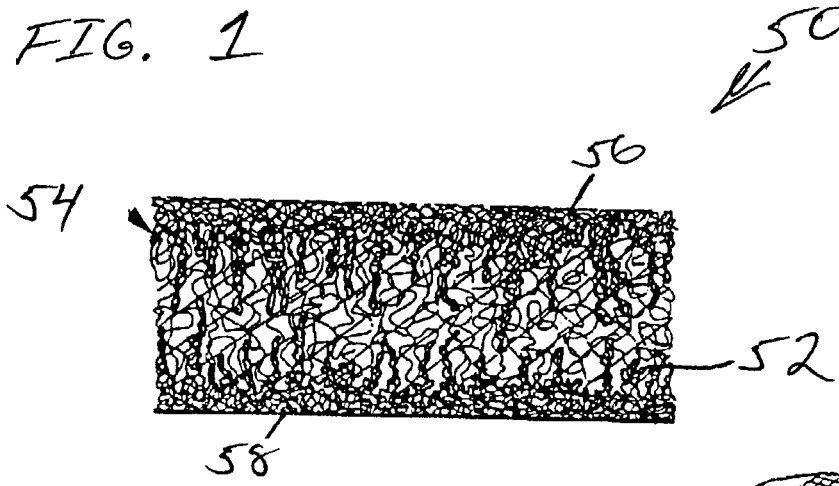
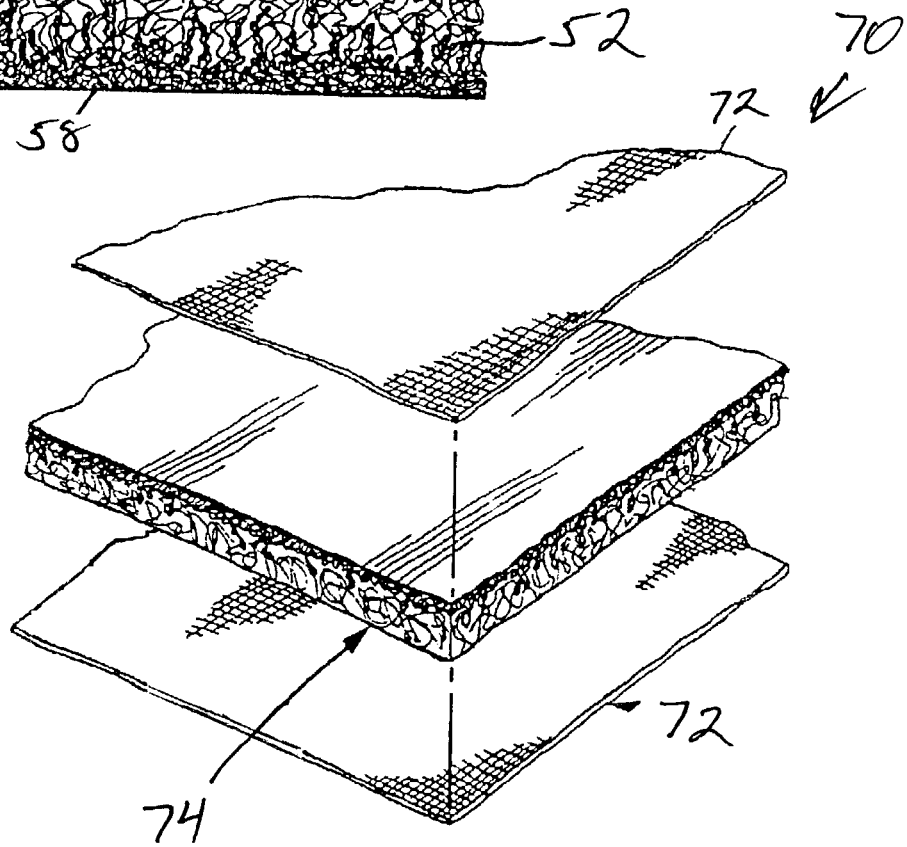
FIG. 2

FABRIC TREATMENT ARTICLE AND METHOD

FIELD OF THE INVENTION

The invention relates to a fabric treatment article, specifically an article having a substrate and a fabric treatment composition absorbed or contained on the substrate, a method of producing the article and a method of treating fabrics with the article.

BACKGROUND OF THE INVENTION

Commercial products available for the care of clothing and fabrics in the home are well known. These products include liquid, powder and tablet detergents, liquid and sheet fabric softeners and other various products. Professional services, such as dry cleaners, are also widely available for cleaning garments subject to shrinkage or for those that are too delicate for common washer/dryer cycles. Typically, desired results from dry cleaning/laundering clothing is stain removal, odor removal, softening, static removal and reduced wrinkling. It is not uncommon for a garment that has recently been cleaned but briefly used to lose those properties that are generally associated with freshly cleaned clothing. Indeed, depending on the environment a fabric is subjected to, odors and wrinkles can quickly render the fabric "unclean" in the eye of the user. For example, a relatively brief exposure to tobacco smoke can leave a noticeable lingering odor on otherwise clean clothing. It is also common for clean clothing to become wrinkled before they are worn, such as when the clothes are packed in a suitcase for travel. Typically, these otherwise clean clothes are either tolerated by the user, ironed, or sent back through an entire cleaning process. Therefore, there is a need for a convenient, cost effective and efficient means for reviving clothing that is not in need of a complete laundering or dry cleaning cycle.

At least one commercially available product, marketed by The Procter & Gamble Company under the name "Dryel", seeks to allow for treatment of clothing in the home dryer. U.S. Pat. No. 5,681,355 is marked on the product and is incorporated herein by reference. The Dryel product consists of a plastic bag, a premoistened cloth, bottled stain removal solution and an absorbent pad for use with the stain removal solution. The user is instructed to: 1) completely remove spots and stains prior to placing garments in the bag, preferably by placing the absorbent pad under the garment; 2) add one to four garments to the bag; 3) insert a premoistened cloth into the bag containing the garments; 4) seal the bag; 5) tumble the bag, garments and cloth in the dryer for 30 minutes at medium to high heat; and 6) hang the garments promptly to help decrease wrinkling. Users of the Dryel product have complained about the need for a bag and its limited capacity and the potential for entrapment, rather than removal, of particulates. Also, the use of the bottle/pad combination to remove stains adds to the complexity of the process. Therefore, there is also a need for a home garment freshening process and product that does not have the known drawbacks of the Dryel product. Such a product and process would preferably eliminate the need for a garment bag and simplify the freshening process.

It is also known to use chemicals in clothes dryers to soften, freshen and reduce static on garments. Fabric softener dryer sheets have been used for these purposes for decades and are described, for example, in U.S. Pat. Nos.: 4,237,155; 4,238,531; 4,327,133; 4,421,792, 5,094,761; 5,234,610; 5,348,667; 5,376,287; and 6,254,932; all of which are incorporated herein by reference. To be effective, however, dryer sheets generally need to interact with damp clothing in order to deliver their intended benefits. As such, these dryer sheets are particularly suited for processing garments after removal from the washing machine and not for dry clothing in need of freshening.

It is also known to cleanse, soften and freshen dry fabrics in clothes dryers as disclosed in e.g. in U.S. Pat. Nos.: 6,243,969; 5,942,484; 6,033,729; 6,315,800; 5,658,651 and PCT W099/19452. Unfortunately these techniques are disadvantageous because of the propensity of the surfactants, dispersing agents or cationic fabric softeners contained in some of these compositions to leave stains on the fabrics being treated. In other cases (e.g. U.S. Pat. Nos. 5,658,651 and 6,254,932) a bag is necessary to contain the garments being treated and is inconvenient to the users. In another case (e.g. U.S. Pat. No. 6,243,969) the high levels of water used inconveniently lengthens the drying time and may cause spotting on silks and other moisture sensitive fabrics.

Therefore, there is need for a fabric freshening product that can deliver deodorization and dewrinkling benefits to relatively dry clothing.

SUMMARY OF THE INVENTION

In one aspect of the invention is a substantially wet fabric treatment article for treating fabrics in a rotary tumble dryer, including but not limited to the following:

a. a treatment article substrate having a hydrophobic and a hydrophilic segment wherein said hydrophobic segment has a capacity to releasably absorb a quantity of an oil and said hydrophilic segment has a capacity to releasably absorb a quantity of water;

b. a fabric treatment liquid or gel composition releasably absorbed on said substrate, said composition containing at least about 50% by wt. of water based on said composition;

c. a fabric treatment component wherein said fabric treatment component does not demonstrate visually perceivable staining of the treated fabrics under standard tumble drying conditions. Standard tumble drying conditions are herein defined as a temperature range of 30–85° C. for time periods in the range of about 1 to 45 minutes;

d. less than about 1.0% by wt. of a surfactant, a dispersing agent, a cationic fabric softener or a blend thereof based on the weight of said composition; and e. wherein said treatment article contains said fabric treatment composition in an amount of about 1.0 grams to less than 190 grams of said composition in the treatment article.

In another aspect of the invention is a method of treating fabrics to remove odors and/or wrinkles without leaving a visible product residue, including but not limited to the steps of:

a. contacting a fabric or garment with a treatment article substrate containing about 3 g to 50 g of a fabric treatment composition comprising at least about 50% water and a non-staining fabric treatment component and less than about 1.0% by wt. of a surfactant, dispersing agent, cationic fabric softener or blend thereof, based on the weight of the fabric treatment composition and wherein said substrate contains about 1% to 50% by wt. of said fabric treatment composition based on the total weight of the treatment article (substrate plus fabric treatment composition).

b. agitating the fabric or garment, the substrate and the non-staining fabric treatment component in a drying apparatus under conditions effective for delivering the major portion of said fabric treatment component to the treated articles under standard tumble drying conditions, wherein the fabric or garment and substrate are allowed to directly contact the inner surface of the dryer while running the drying apparatus, and wherein the treatment does not leave a visible residue on the fabric or garment.

In another aspect of the invention is a process for manufacturing the inventive article where the fragrance is applied to the substrate in a separate step from the water by spraying, coating or dipping. In a further aspect of the invention is a process for manufacturing the inventive article where the fragrance and fabric treatment composition are continuously homogenized and the homogenized composition contains at least about 50% by wt. of droplets with a diameter below about 50 microns, said composition being applied to said substrate within about 30 seconds by spraying, coating or dipping, and the like.

DETAILED DESCRIPTION

BRIEF DESCRIPTION OF THE DRAWINGS

FIG. 1 is a partial, cross-sectional view of one embodiment of a fabric treatment article of the present invention.

FIG. 2 is an exploded partial top perspective view of a second embodiment of a fabric treatment article of the present invention.

DETAILED DESCRIPTION OF PREFERRED EMBODIMENTS

Figure 3:
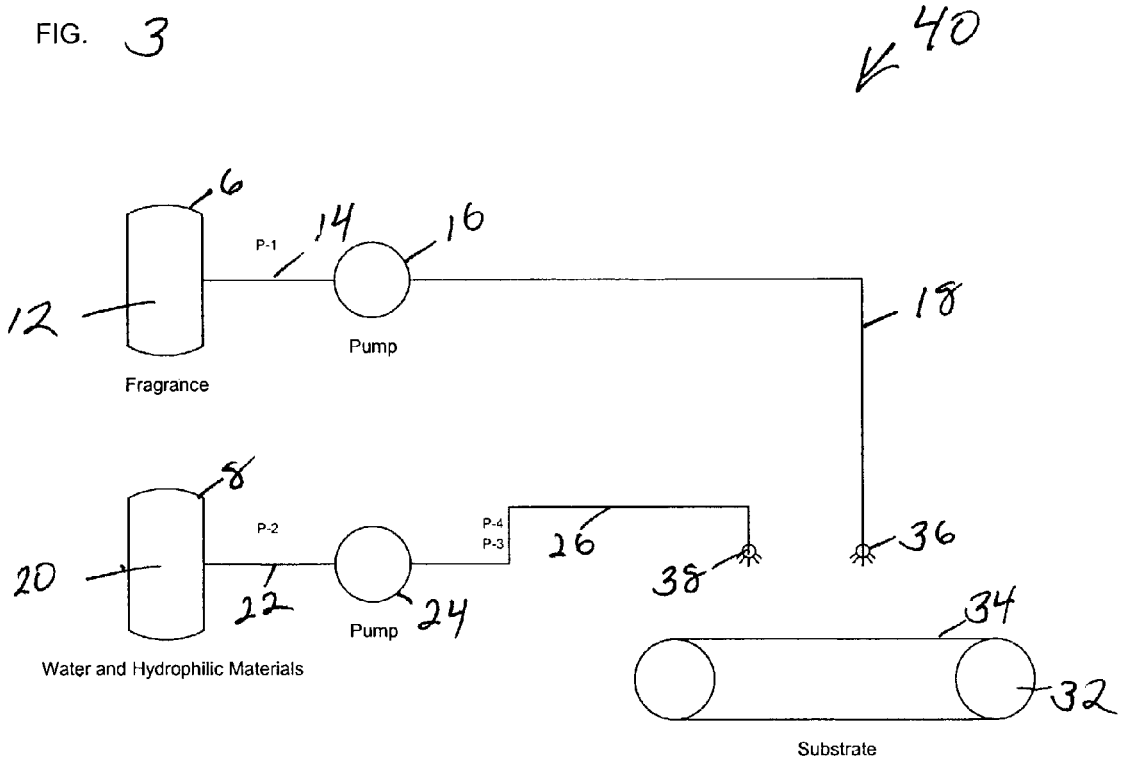
FIG. 3 is a diagrammatic and schematic representation of a method for producing one embodiment of a fabric treatment article of the present invention.

Referring to FIG. 1, a first embodiment of a preferred substrate 50 of a single layer fabric treatment article of the present invention is shown having hydrophilic fibers 52 (such as cellulose, rayon, blends thereof and the like) and hydrophobic fibers 54 (such as polyolefin, polyester, nylon, blends thereof and the like) uniformly blended together. Also shown are first and second outer surfaces 56 and 58 respectively of substrate 50.

Referring to FIG. 2, a second embodiment of a preferred substrate 70 of a three layer laminated fabric treatment article of the present invention is shown having hydrophobic outer layers 72 composed of a porous substrate such as polyolefin or polyurethane open cell sponge and the like being adhered to hydrophilic inner layer composed of e.g. cellulose, rayon, blends thereof and the like.

Referring to FIG. 3, a method for preparing a fabric treatment article of the present invention is diagrammatically illustrated. Fragrance solution 12 contained in storage tank 6 feeds pump 16 through conduit 14 and is pumped to spray nozzle 36 via conduit 18. Spray nozzle 36 deposits a predetermined pattern of fragrance solution 12 onto fabric treatment article substrate 34 transported over rollers 32. Simultaneously or sequentially with the deposition of fragrance solution 12 onto substrate 34, water solution (including optionally other dissolved or suspended materials) 20 contained in storage tank 8 feeds pump 24 through conduit 22 and is pumped to spray nozzle 38 via conduit 26. Spray nozzle 38 deposits a predetermined pattern of water solution 20 onto fabric treatment article substrate 34 transported over rollers 32.

Figure 4:
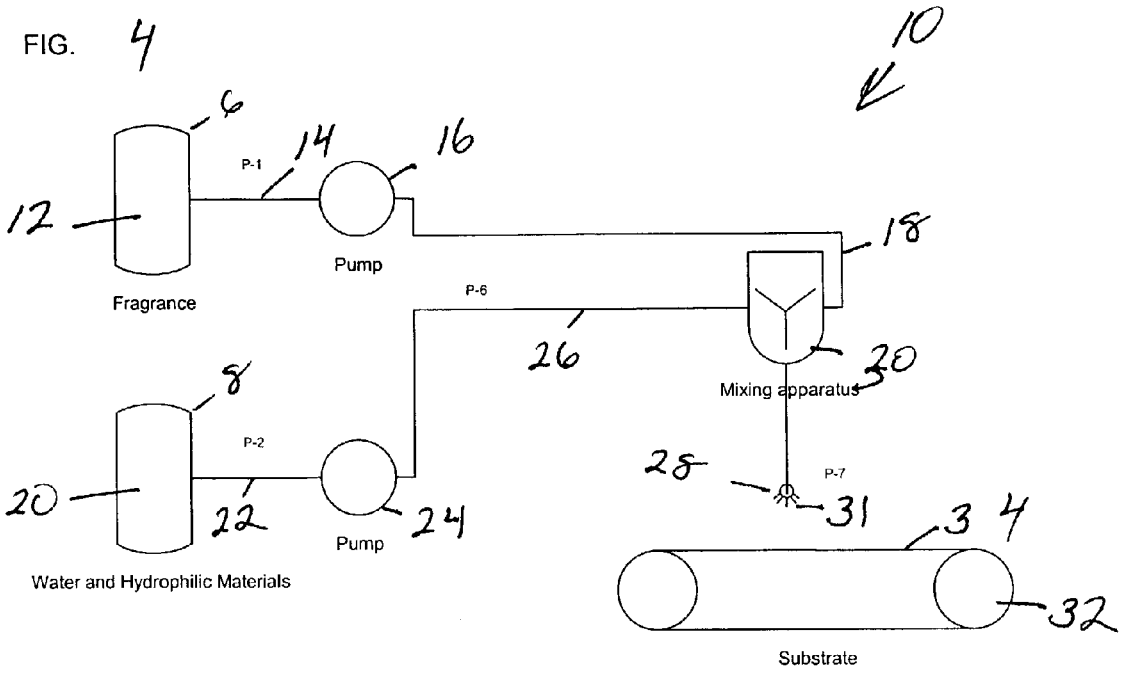
FIG. 4 is a diagrammatic and schematic representation of a second method for producing a second embodiment of a fabric treatment article of the present invention.

Referring to FIG. 4, a second method for preparing a fabric treatment article of the present invention is diagrammatically illustrated. Fragrance solution 12 contained in storage tank 6 feeds pump 16 through conduit 14 and is pumped to mixing apparatus 30 via conduit 18. Simultaneously water solution (including optionally other dissolved or suspended materials) 20 contained in storage tank 8 feeds pump 24 through conduit 22 and is pumped to mixing apparatus 30 via conduit 26. Spray nozzle 28 deposits a predetermined pattern of intimately blended fragrance and water solution 31 from mixing apparatus 30 onto fabric treatment article substrate 34 transported over rollers 32.

In one aspect of the invention is a substantially wet fabric treatment article for treating fabrics in a rotary tumble dryer, including but not limited to the following:

a. a treatment article substrate having a hydrophobic and a hydrophilic segment wherein said hydrophobic segment has a capacity to releasably absorb a quantity of an oil and said hydrophilic segment has a capacity to releasably absorb a quantity of water;

b. a fabric treatment liquid or gel composition releasably absorbed on said substrate, said composition containing at least about 50%, preferably 80%, and more preferably 90% by wt. of water based on said composition;

c. a fabric treatment component wherein said fabric treatment component does not demonstrate visually perceivable staining of the treated fabrics under standard tumble drying conditions preferably in the time range of about 5 to 30 minutes;

d. less than about 1.0% by wt. of a surfactant, a dispersing agent, a cationic fabric softener or a blend thereof based on the weight of said composition; and e. wherein said treatment article contains said fabric treatment composition in an amount of about 1.0 grams to less than 190 grams, preferably with an upper limit of 150, 130, 100, 80, 70, 60, 50, 40, 30 or 25 grams of said composition and a lower limit of about 2, 3, 4 or 5 grams of said composition in the treatment article.

Advantageously the article has a ratio of hydrophobic capacity to absorb oil to hydrophilic capacity to absorb water in the range of about 99:1 to 1:99, more preferably in the range of about 60:40 to 10:90. Preferably the article has a substrate including but not limited to a nonwoven textile having at least one layer. Preferably the nonwoven textile contains fibers with hydrophilic surfaces and fibers with hydrophobic surfaces in the same layer or in different layers and the nonwoven textile contains a blend of rayon and polyester fibers in the ratio range of about 1:99 to 99:1, preferably in the ratio range of about 50:50 to 90:10. More preferably the inventive article contains a fabric treatment component that is a fragrance and has volatility such that organoleptically perceivable fragrance and/or absence of malodor is delivered to the treated fabrics upon treatment in a rotary tumble dryer (preferably for a time in the range of about 5 and 30 minutes and a temperature in the range of about 30 and 85° C.).

Advantageously the fragrance is in the concentration range of about 0.01 to 10% by wt. (preferably about 0.5 to 5% by wt) of the fabric treatment composition. Preferably the fabric treatment composition further comprises a buffering agent (preferably selected from sodium citrate, sodium borate, sodium bicarbonate, sodium carbonate or blends thereof. More preferably the fabric treatment composition further comprises less than about 5% nonvolatile matter (preferably less than about 1% and more preferably less than about 0.5%).

In another aspect of the invention is a method of treating fabrics to remove odors and/or wrinkles without leaving a visible product residue, including but not limited to the steps of:

a. contacting a fabric or garment with an treatment article substrate containing about 3 g to 50 g (preferably about 5 g to 25 g) of a fabric treatment composition comprising at least about 50% (preferably about 90%) water and a non-staining fabric treatment component and less than about 1.0% by wt. of a surfactant, dispersing agent, cationic fabric softener or blend thereof, based on the weight of the fabric treatment composition and wherein said substrate contains about 1% to 50% by wt. of said fabric treatment composition based on the total weight of the treatment article (substrate plus fabric treatment composition).

b. agitating the fabric or garment, the substrate and the non-staining fabric treatment component in a drying apparatus under conditions effective for delivering the major portion of said fabric treatment component to the treated articles under standard tumble drying conditions, wherein the fabric or garment and substrate are allowed to directly contact the inner surface of the dryer while running the drying apparatus, and wherein the treatment does not leave a visible residue on the fabric or garment.

Preferably the garments are not placed in a bag during the agitation process.

In another aspect of the invention is a process for manufacturing the inventive article where the fragrance is applied to the substrate in a separate step from the water by spraying, coating or dipping. In a further aspect of the invention is a process for manufacturing the inventive article where the fragrance and fabric treatment composition are continuously homogenized until transfer to a spraying, coating or dipping device; the homogenized composition containing at least about 50% by wt. of droplets with a diameter below about 50 microns, said composition being applied to said substrate within about 5 minutes, preferably within about 1 minute, after the transfer by spraying, coating or dipping, and the like.

Fabric Treatment Components

Perfume is an especially useful fabric treatment component of the invention, as it provides one or more end use benefits. Among these benefits are its providing the consumer with a pleasing fragrance upon opening the package and upon the addition of one or more substrate clothes to the tumble dryer. Other benefits provided by the perfume include the removal of offensive odors contained on the garments being treated. Typical odors to be removed include smoke, cooking residues, body odors and musty, damp smells among others. The fragrances suitable for the invention can be blended with an aqueous solution under high shear so that they can be readily applied to the substrate. They should be of suitable intensity to be effective in malodor reduction even a day after treatment, yet not be so volatile that they are lost in the drying process.

Any conventional or available fragrance or fragrance ingredient may be used in this invention provided they are consistent with the objectives of the invention. As representative fragrances and fragrance ingredients that may be included are all natural products in this category such as essential oils, absolutes, resinoids, resins, concretes etc., and synthetic perfume components such as hydrocarbons, alcohols, aldehydes, ketones, ethers, acids, esters, acetals, ketals, nitriles etc., including saturated and unsaturated components, aliphatic, carboxylic and heterocyclic compounds. Examples of such perfume components are: geraniol, geranyl acetate, linalool, linayl acetate, tetrahydrolinalool, citronellol, citronellyl acetate, dihydromyrcenol, dihydromyrcenyl acetate, tetrahydromyrcenol, terpineol, terpinyl acetate, nopol, nopyl acetate, 2-phenylethanol, 2-phenylethyl acetate, benzyl alcohol, benzyl salicylate, benzyl benzoate, amyl salicylate, dimethylbenzyl carbinol, trichloromethylphenylcarbinyl acetate, p-tert, butyl-cyclo-hexyl acetate, isonyl acetate, vetiveryl acetate, vetiverol, alpha-n-amylcinammic aldehyde, alpha-hexylcinammic aldehyde, 2 methyl-3(p-tert butlyphenyl)-propanol, n-decane, 9-decenol-1 phenoxyethyl isobutyrate, phenylacetaldehyde dimethyl acetal, phenylacetaldehyde diethyl acetal, geranonitrile, citronellonitrile, cedryl acetate, 3-isocamphylcyclohexanol, cedryl methyl ether, isolongifolanone, aubepine nitrile, aubepine, heliotropine, coumarin, vanillin, diphenyl oxide, hydroxy-citronellal, ionones, methylionones, isomethylionones, irones, cis-3-hexanol and esters thereof, indane musk fragrances, tetralin musk fragrances, isochroman musk fragrances, macrocyctic ketones, macrolactone musk fragrances, ethylene brassylate, aromatic nitro-musk fragrances, bergamont oil, coriander oil, dimethyl heptanol, dimethyl benzyl carbinyl acetate, geranyl acetate, rose synthetic, geranium bourbon, hedione, iso eugenol, methyl eugenol, styrallyl acetate, stemone, rose oxide laevo, aldehyde C-11 undecyclic, vertivent oil, quaiac wood oil, esters of anthranilic acid, benzyl salicylate, benzyl benzoate, oak moss and p-tert-butyl cyclohexyl acetate and the like.

The amount of fragrance can be varied as desired. Typically a sufficient and effective amount will range from about 0.1 to about 4% of the fabric treatment composition that is absorbed onto or into the fabric treatment article.

Optionally other fabric treatment ingredients may be employed provided they leave no objectionable stains on fabrics treated with the inventive fabric treatment article at the concentration they are employed. This can be demonstrated using the Stain determination method described below.

The optional ingredients disclosed below can enhance the properties of the fabric treatment composition. Examples of such components include, but are not limited to: fluorescent whitening agents, fiber lubricants, sizing agents, buffers, colorants, pro-fragrances, preservatives, insect repellents, aesthetic agents, deodorizers, germicides, fungicides and the like.

Fabric Treatment Article

Any absorbent substrate or article having hydrophobic and hydrophilic segments that can contain or absorb oily and aqueous components may be used as a vehicle for delivering the benefit agents of this invention to the fabrics or garments to be treated. The substrate may be finely divided but such comminuted substrates would have to be separated from the fabrics they are used to treat. Obviously, nearly all materials have at least a small capacity to absorb or contain liquids, although in most cases it will be preferred to use a substrate with an absorption factor ($A_F$) of at least about 3, wherein absorption factor is defined as:

$$A_F = (\text{mass of water absorbed by substrate})/(\text{mass of substrate})$$

The fabric treatment article advantageously includes at least one layer or zone of an open cell sponge, porous polymer, porous ceramic, or fiber aggregate such as paper, wet-processed or dry-processed nonwoven fabric, woven fabric or knitted fabric,. Optionally the layer or zone contains multiple apertures or cells having a range of area or volume of about 0 to 100 mm2 or about 0 to 1 cm3 respectively and a total surface area of about 0 to 40% based on the entire layer. It is particularly preferred to use a nonwoven fabric for its absorption performance and from economical considerations. Where the article sheet is a fiber aggregate, it is preferred for the fibers constituting the fiber aggregate to have both hydrophilic and hydrophobic fibers or a combination of fibers with hydrophilic surfaces and fibers with hydrophobic surfaces, or any combination of surface treated and untreated fibers that provide distinct hydrophilic and hydrophobic segments capable of releasably absorbing aqueous and oily components respectively. Advantageously the article sheet will contain at least about 1.0% by wt. (based on a dry substrate) of hydrophilic fibers or hydrophobic fibers with hydrophilic surface treatments, and preferably at least about 2, 3, 5, 7, 10, 15, 20, 25 and 30% by wt. of such fibers with the remainder of the article including fibers with hydrophobic surfaces or other material, In addition the article sheet will advantageously contain at least about 0.1, 0.2, 0.3, 0.4, 0.5, 1, 2, 3, 5, 7, 10, 15, 20, 25 and 30% by wt. based on the dry substrate of hydrophobic fibers, hydrophilic fibers with hydrophobic surface treatments, hydrophobic segments or combinations thereof. As used herein, releasably absorbing means that the components are absorbed within the fabric treatment article but that the fabric treatment article releases the major portion, i.e. greater than 50% by wt. of the absorbed material under conditions of tumble drying in the temperature range of about 35 to 85° C. Preferably the article releases more than 60, 70, 80, 90 or 95% by wt. of the components absorbed onto or into the article during the fabric treatment process.

Useful hydrophilic fibers include cellulosic fibers, e.g., wood pulp and cotton, natural fibers such as flax, and cellulosic chemical fibers such as viscous rayon, Tencel, and other cellulosic derivatives. Hydrophobic synthetic fibers whose surface has been rendered hydrophilic are also useful. Useful fabrics include wet-processed nonwoven fabrics and dry-processed fabrics such as thermally bonded nonwoven, chemically bonded nonwoven, needle-punched nonwoven, spunlaced nonwoven and the like. In using paper made mainly of hydrophilic fibers, as an article, any of wet-processed pulp sheeting prepared from pulp by papermaking processing, wet-processed binder sheeting having enhanced wet strength by applying a binder after papermaking, dry-processed pulp sheeting prepared by adhering disintegrated and accumulated pulp fibers with a binder and shaping into a sheet form, and the like can be used. The binder will advantageously have hydrophobic properties and can comprise all or a portion of the hydrophobic segment. Other examples of useful hydrophobic fibers include polyester, polyolefin, acrylic and polyamide fibers and the like. Hydrophilic fibers that have hydrophobically modified surfaces may also be used.

The article used herein is most preferably non-linting. By "non-linting" is meant an article which resists the shedding of visible fibers or microfibers onto the fabrics being refreshed, i.e., the deposition of what is known in common parlance as "lint". A article can easily and adequately be judged for its acceptability with respect tq its non-linting qualities by rubbing it on a piece of dark blue woolen cloth and visually inspecting the cloth for lint residues. The non-linting qualities of sheet or pad type articles used herein can be achieved by several means, including but not limited to: preparing the article from a single strand of fiber; employing known bonding techniques commonly used with nonwoven materials, e.g., point bonding, print bonding, adhesive/resin saturation bonding, adhesive/resin spray bonding, stitch bonding and bonding with binder fibers. In an alternate mode, an article can be prepared using an absorbent core, said core being made from a material which, itself, sheds lint. The core is then enveloped within a sheet of porous, non-linting material having a pore size which allows passage of the refreshment fabric treatment compositions, but through which lint from the core cannot pass. An example of such a article comprises a cellulose or polyester fiber core enveloped in a non-woven polyester scrim.

The article should be of a size which provides sufficient surface area that effective contact between the surface of the article and the surface of the fabrics being treated is achieved. Of course, the size of the article should not be so large as to be inconvenient for the user. Typically, the dimensions of the article will be sufficient to provide a macroscopic surface area (all sides of the article) of at least about 200 cm2 preferably in the range from about 200 to about 5000 cm2. For example, a flat rectangular article may have the dimensions (X-direction) of from about 10 cm to about 50 cm, and (Y-direction) of from about 10 cm to about 50 cm. Two or more smaller articles can be used when a larger surface area is desired (or needed). Nonwoven fabrics that are useful for the inventive fabric treatment article have the following properties:

| Property | Units | Preferred Range | Optional Range |
|---|---|---|---|
| Basis Weight | gm/m2 | 40–80 | 35–100 |
| Thickness | microns | 300–750 | 100–1500 |
| Density | gm/cc | 0.05–0.25 | 0.05–0.35 |
| Dry Tensile | N | | |
| MD | | 500–1000 | 50–2000 |
| CD | | 50–300 | 5–500 |
| Wet Tensile | N | | |
| MD* | | 50–500 | 10–1000 |
| CD* | | 10–200 | 5–500 |
| Brightness | % | 80–95 | 60–99 |
| Absorption Capacity (water) | % | 500–1200 | 300–1500 |

*MD machine direction; CD cross direction

Especially preferred article substrates are spunlaced or hydroentangled nonwovens, which have been found to be both durable and compatible with the fabric treatment compositions of this invention. Commercial examples of suitable spunlaced nonwovens include approximately 70/30 blend of rayon and polyester Grade 7027 and Grade 7086, both available from PGI (Mooresville, N.C.). A single layer embodiment of the inventive fabric treatment article is depicted in FIG. 1 and a multilayer embodiment of the inventive fabric treatment article is depicted in FIG. 2.

Water Content

The minimum amount of water to be used in the fabric treatment composition is that which, depending on the fabric treatment article or substrate size and fabric treatment composition, is enough to render the article or substrate substantially wet to the touch. The term "substantially wet," as used herein, means that prior to use the article contains sufficient water so that it generally feels wet to the touch. Thus, the articles of the present invention will generally comprise more than about 10%, 20%, 30%, 40%, 50%, 60%, 70%, 80% and preferably more than about 90% by weight of water based on the dry substrate; the forgoing measured in a standard environment, e.g., 25° C. and 50% relative humidity. One of ordinary skill in the art would recognize that the water content of an article such as in the present invention can vary with the relative humidity of the environment.

The water in the inventive articles of this disclosure is observed to serve several purposes. While not wishing to be bound by the following mechanism, it is believed that water can act a wrinkle-release agent, as it slightly remoistens the treated articles, which permits the fibers of the treated fabrics to relax and reset in a less wrinkled state. Furthermore, it may serve as a vehicle for transferring one or more non-staining fabric treatment or benefit agents, such as fragrances, brighteners and the like to the treated garments. While other solvents could conceivably be chosen, either alone or in combination with water, it is highly desirable that water make up the dominant fraction of the article liquid, due to its excellent environmental profile, nonflammability, lack of odor and low cost. As such, the fabric treatment compositions of this invention tend to comprise at least about 80% water, preferably at least 90% water and most preferably at least 95% water based on the liquid composition.

It is also advantageous to minimize the amount of nonvolatile matter, exclusive of substrate, that it added to the fabric treatment compositions of this invention. For the purposes of this disclosure, "nonvolatile matter" is defined as substances, exclusive of the substrate, wherein at least 50% of said agent remains after a 10 g sample is heated in a 50 C convection oven for 24 hours. While in some embodiments of this invention, the addition of small amounts of nonvolatile matter may be desirable if not necessary, these materials can often leave visible residues on the treated articles. As such, the preferred embodiments of this invention limit nonvolatile matter to no more than about 5, 4, 3, 2 or 1% of the total fabric treatment composition weight. Furthermore, it has been found that surfactants and dispersing agents are an especially problematic form of nonvolatile matter, as they can cause substantial oily stains on garments. It is thus desirable for the articles of this invention to contain less than about 1.0, 0.9, 0.8, 0.7, 0.6, 0.5, 0.04, 0.3, 0.1 or 0.05 % by wt. based on the fabric treatment composition, of surfactants and dispersing agents combined, and preferably to be essentially free of surfactants or dispersing agents. Problematic surfactants include anionic, nonionic, cationic, amphoteric, and zwitterionic surfactants. Problematic dispersants include water soluble or dispersible polymers such as polyvinylpyrrolidone, polyvinylalcohol, polyacrylamides, polyacrylates and the like. Other dispersants include modified starches and celluloses, fatty acids and alcohols, polysaccharide gums, hydrocarbon and polyolefin waxes, and dispersant minerals such as modified clays and the like.

Method of Use

The articles of this invention can be used to impart their fabric treatment composition to articles of clothing or other items via their use in a rotary tumble dryer or similar apparatus.

Generally the method of use of the articles of this invention comprises commingling the clothing or other items to be treated with one or more of the articles of this invention, preferably a nonwoven cloth impregnated with the fabric treatment composition within the drum of a rotary dryer or similar apparatus. The combination of the tumbling action of the dryer combined with the flow of vented air through the dryer provides an effective means of providing the benefits of this invention. These benefits include the removal of offensive odors and the reduction in the wrinkled appearance of clothes, particularly in those loads in which the clothes were not pre-moistened.

While a heated air stream is not required for this invention to be effective, heating the contents of the dryer drum via a vented hot air stream furthers the effective use of this invention by lessening the time required for provision of its benefits. Typical time periods for use vary from about 10 minutes to about 80 minutes depending on the weight of the clothing load and the temperatures and dryer use cycles chosen.

Removal of the clothes from the dryer promptly on completion of the moisture removal from the garments or other articles being treated will facilitate the delivery of the wrinkle reduction and odor removal benefits of this invention.

Method of Production

The manufacture of fabric treatment articles having a blend of fragrances and water that are substantially free of surfactants or dispersing agents is difficult since fragrances, especially oily fragrances, are usually incompatible with water, and cannot easily be stabilized without sufficient levels of surfactants or dispersing agents. This makes standard wet wipe processing techniques, where all raw materials are blended and stored in a tank prior to application to the substrate, incompatible with the articles of this invention.

Surprisingly, it has been found that the substrates of this invention exhibit a stabilizing effect on the water/oily fragrance mixture. Without wishing to be bound by theory, it is believed that the use of a base material comprised of both hydrophilic and hydrophobic segments, such as a) a nonwoven consisting of 50% polyester and 50% rayon, b) a layered article containing in one layer a hydrophobic sponge and in an adjacent layer a hydrophilic cellulosic batting, and the like, aids in this process by allowing the fragrance to migrate to the hydrophobic portions while the aqueous phase is retained by the hydrophilic elements. Thus, a uniform fabric treatment article, with fragrance evenly dispersed on at least a portion of the article substrate, can be obtained by first applying the perfume via an atomized spray to the article substrate or its hydrophobic segment if separate, followed by subsequent addition of an aqueous base to the substrate or its hydrophilic segment if separate. The reverse of this process, first dosing the substrate with a water-based fabric treatment composition, followed by spray application of the fragrance, has also proven to be effective. Dosing may be done sequentially or simultaneously. An example of this process is shown in FIG. 3.

Alternatively, it has been found that the inventive fabric treatment article may also be manufactured by blending the fragrance and water under high shear to create a meta-stable intermediate. This is then applied to the substrate via a spray nozzle or other means in a finely dispersed state, to create the final, homogenous product. Should this embodiment be chosen, the time between dispersion under high shear and combining the fragrance/aqueous phase dispersion with the substrate will preferably be less than about 5 or 1 minute, preferaly less than about 30 or 15 seconds. An example of this process is shown in FIG. 4.

Examples of useful devices for application of the fabric treatment composition to the substrate may include (but are not restricted to) the following: spray nozzles, pipettes, rollers, dipping troughs or trays, brushes, application rods (rods with small apertures designed to apply the composition in a fine mist to the substrate), and the like.

Preservatives

Optionally, a soluble preservative may be added to this invention. Contamination of the product by microorganisms, which can occur through both raw materials and consumer use, can have a number of undesirable effects. These include phase separation, the formation of bacterial and fungal colonies, the emission of objectionable odors and the like. The use of a preservative is especially preferred as the fabric treatment composition of this invention is a liquid, and tend to be especially susceptible to microbial growth.

The use of a broad-spectrum preservative, which controls the growth of bacteria and fungi is preferred. Limited-spectrum preservatives, which are only effective on a single group of microorganisms may also be used, either in combination with a broad-spectrum material or in a "package" of limited-spectrum preservatives with additive activities. Depending on the circumstances of manufacturing and consumer use, it may also be desirable to use more than one broad-spectrum preservative to minimize the effects of any potential contamination.

The use of both biocidal materials, i.e. substances that kill or destroy bacteria and fungi, and biostatic preservatives, i.e. substances that regulate or retard the growth of microorganisms, may be indicated for this invention.

In order to minimize environmental waste and allow for the maximum window of fabric treatment composition stability, it is preferred that preservatives that are effective at low levels be used. Typically, they will be used only at an effective amount. For the purposes of this disclosure, the term "effective amount" means a level sufficient to control microbial growth in the product for a specified period of time, i.e., two weeks, such that the stability and physical properties of it are not negatively affected. For most preservatives, an effective amount will be at between about 0.00001% and 0.5% of the total fabric treatment composition, based on weight.

Preferred preservatives for the fabric treatment compositions of this invention include organic sulfur compounds, halogenated materials, cyclic organic nitrogen compounds, low molecular weight aldehydes, quaternary ammonium materials, dehydroacetic acid, phenyl and phenoxy compounds, mixtures thereof and the like.

Examples of preferred preservatives for us in this invention include, but are not limited to the mixture of about 77% 5-chloro-2-methyl-4-isothiazolin-3-one and about 23% 2-methyl-4-isothiazolin-3-one, which is sold commercially as a 1.5% aqueous solution by Rohm & Haas (Philadelphia, Pa.) under the trade name Kathon; 1,2-benzisothiazolin-3-one, which is sold commercially by Avecia (Wilmington, Del.) as, for example, a 20% solution in dipropylene glycol sold under the trade name Proxel GXL; and a 95:5 mixture of 1,3 bis (hydroxymethyl)-5,5-dimethyl-2,4 imidazolidinedione and 3-butyl-2-iodopropynyl carbamate, which can be obtained, for example, as Glydant Plus from Lonza (Fair Lawn, N.J.).

As mentioned above, the preservatives are generally only used at an effective amount so as not to degrade product stability. It is conceivable, however, that they could also be used at higher levels in the fabric treatment compositions of this invention to provide a transient or durable biostatic or antibacterial effect on the treated articles.

Fluorescent Whitening Agents

Many fabrics, and cottons in particular, tend to lose their whiteness and adopt a yellowish tone after repeated washing. As such, it is customary and preferred to add a small amount of fluorescent whitening agent, which absorbs light in the ultraviolet region of the spectrum and re-emits it in the visible blue range, to the fabric treatment compositions of this invention.

Suitable fluorescent whitening agents include derivatives of diaminostilbenedisulfonic acid and their alkali metal salts. Particularly, the salts of 4,4'-bis(2-anilino4-morpholino-1,3,5-triazinyl-6-amino)stilbene-2,2'-disulfonic acid, and related compounds where the morpholino group is replaced by another nitrogen-comprising moiety, are preferred. Also preferred are brighteners of the 4,4'-bis(2-sulfostyryl) biphenyl type, which may optionally be blended with other fluorescent whitening agents at the option of the formulator. Typical fluorescent whitening agent levels in the preparations of this invention range between 0.001% and 1%, although a level between 0.1% and 0,3%, by wt., is normally used based on the fabric treatment composition. Commercial supplies of acceptable fluorescent whitening agents can be sourced from, for example, Ciba Specialty Chemicals (High Point, N.C.) and Bayer (Pittsburgh, Pa.).

Buffering Agents

A buffer or buffer system is particularly important when fabric treatment compositions are susceptible to pH drift, either through hydrolysis, oxidation, or other decomposition mechanisms of specific components or through exposure of the product to the atmosphere, which can act to lower the pH of unbuffered products. To prevent this pH drift and its potential to either degrade fabric treatment composition components or make the system more vulnerable to microbiological contamination, it is important to buffer the solution in a prefered pH range and to provide sufficient buffering capacity to maintain the pH in light of any acids or bases produced by low levels of hydrolysis or other decomposition reactions.

Many commonly used buffers are listed and discussed in the book "Buffers for pH and Metal Ion Control" by D. D. Perrin and B. Dempsey (John Wiley and Sons, 1974). Buffers suitable for use in this invention include those capable of keeping the product pH between about 5.5 and 9.5 and more preferably between about 7 and 9. The buffers selected for use in this invention would preferably need to maintain the product pH within this range for periods of at least 12 months or greater under expected storage conditions to allow for the product to be made, sold and used by the consumer with its optimal performance benefits intact.

Specific buffers included within the scope of this invention include the use of acid-base conjugate pairs and their salts as well as the acids and bases themselves used independently. Examples of acid-base pairs include: Tris (hydroxymethylaminomethane) HCL, Borax/HCL and sodium carbonate/sodium bicarbonate. Individual bases that can be used alone include the sodium and potassium salts of citrate, bicarbonate, borate and carbonate as well as use of ethanolamines such as mono, di and triethanolamine. The use level of the buffers will depend on the relative buffering strength of the system chosen but will typically be used between 0.0001% and 5%, preferably at a level of between about 0.05% and 5%, more preferably between about 0.1% and 2%, based on total weight of the fabric treatment composition. Buffers that add undesirable odor to the fabric treatment composition, for example, acetic acid/sodium acetate and ammonia/ammonium hydroxide, are not typically used, because they may interfere with the fragrance and/or leave an odor that is not aesthetically pleasing on treated fabrics.

Fiber Lubricants

In order to enhance the conditioning, softening, wrinkle-reduction and protective effects of the fabric treatment compositions of this invention, it is often desirable to optionally include one or more fiber lubricants in the fabric treatment composition. Such ingredients are well known to those skilled in the art, and are intended to reduce the coefficient of friction between the fibers and yarns in articles being treated, both during and after the wash process. This effect can in turn improve the consumer's perception of softness, minimize the formation of wrinkles and prevent damage to textiles during the wash. For the purposes of this disclosure, "fiber lubricants" shall be considered non-cationic, substantially hydrophobic materials intended to lubricate fibers for the purpose of reducing the friction between fibers or yarns in an article comprising textiles which provide one or more wrinkle-reduction, fabric conditioning or protective benefit.

Examples of suitable fiber lubricants include oily plant, synthetic and animal-derived triglyceride oils, silicones such as polydimethylsiloxane and mineral oils, and the like. If fiber lubricants are used, they are employed in concentration ragnes of about 0 to 10% by wt., preferably about 0 to 5% by wt. based on the fabric treatment composition weight but not at a level that would cause any visible staining of the fabrics being treated. Such fiber lubricants may be deposited onto the fabric treatment article substrate simultaneously with the fabric treatment composition or as a separate addition step during the manufacturing process.

Organic solvents, such as methyl methoxybutanol or propylene glycol, may be included in the composition; however, because the composition is intended for use in a tumble dryer, the organic solvent should not be flammable (i. e., its flash point should not be below the maximum temperature of the dryer or about 85° C.) or release a toxic vapor upon heating to a maximum of 85° C. Suitable organic solvents may be added at about 0 to 15%, more preferably, about 0 to 10% based on the weight of the fabric treatment composition.

The following examples will more fully illustrate the embodiments of this invention. All parts, percentages and proportions referred to herein and in the appended claims are by weight unless otherwise illustrated. Physical test methods are described below. The nonwoven substrate used for all examples is Duralace 7086 by Polymer Group, Inc., which has the following properties:

| | |
|---|---|
| Composition of nonwoven: | 90% fiber, 10% binder |
| Fiber composition: | 70% rayon, 30% polyester |
| Weight | 65 g/m2 |
| Thickness (4 plies) | 3.1 mm |
| Absorbence capacity: | 900% |

EXAMPLE 1

This example demonstrates the propensity for a dispersing agent such as coconut oil fatty acid to stain fabrics during use of a comparative fabric treatment article compared to the inventive article. The inventive article free of dispersing agent did not show staining.

The following two fabric treatment compositions were prepared and applied by pipette to a nonwoven substrate of 70% rayon and 30% polyester.

Comparative fabric treatment composition #1

| Ingredient | % As is |
|---|---|
| Water | 50 |
| Coconut Oil Fatty Acid | 18 |
| 50% Sodium Hydroxide | approx 1.2 |
| Perfume | 0.5 |
| Water | qs to 100 |

Inventive Fabric treatment composition #2

| Ingredient | % As is |
|---|---|
| Water | 99 |
| Sodium Citrate | 0.5 |
| Perfume | 0.5 |

In each case, fabric treatment composition ingredients were blended together and homogenized. Then 25 g of the mixture was evenly applied to the 8×10" nonwoven sheet having dimensions of 20×28 cm.

Garments and test cloths were pre-cleaned using all® Free and Clear® liquid fragrance-free detergent manufactured by Unilever Home and Personal Care NA by completing 3 consecutive wash cycles to remove residual soils. A wash temperature of approximately 60° C. and a 12 minute wash time was used. Since the fabric treatment article is recommended for use on dry garments, garments and test cloths were also dried without a fabric treatment article prior to test use.

Two pairs of Khaki pants, 2 cotton shirts and 4 polyester test cloths (i. e., pongee) were placed in each of 2 dryers. One fabric treatment article was placed in each dryer. The loads were tumble dried for 15 minutes at a low heat setting (corresponding to a temperature of approx. 50° C.). All items were removed and folded. The experiment was then repeated.

The incidence of staining on the garments and test cloths was evaluated after 24 hours, according to the following standard method used for tumble dryer sheets. In this method, stains are given a rank score based on the following guidelines:

| Score | Description | Detailed Definition |
|---|---|---|
| 0 | No staining | No appearance of stains |
| 1 | Trace | 1–2 small, light spots |
| 2 | Slight | 3–6 small, light spots or 1–2 small, slightly heavy spots or 1 medium, light area |
| 3 | Moderate | 7–10 small, light spots or 3–6 small, slightly heavy spot or 2–3 medium, light areas or 1 medium heavy area |
| 4 | Heavy | 11–15 small, light spots or 7–10 small, slightly heavy spot or 4+ medium, light areas or 2 large heavy areas |
| 5 | Extreme | 15+ small, light spots or 10+ small, slightly heavy spot or 3+ large heavy areas |

Results comparing Comparative Fabric treatment composition #1 and Inventive Fabric treatment composition #2 below clearly show staining resulting from the inclusion of a dispersing agent in the comparative case.

| Results for Comparative fabric treatment composition #1 | | | |
|---|---|---|---|
| 1st Set | Score | | |
| Khaki | 1 | | |
| Purple Shirt | 2 | | |
| Pink Pongee (4) | 3, 2, 3, 3 | Average | 2.7 |
| 2nd Set | Score | | |
| Khaki | 1 | | |
| Purple Shirt | 3 | | |
| Pink Pongee (4) | 3, 4, 4, 4 | Average | 3.2 |

| Results for Inventive fabric treatment composition #2 | | | |
|---|---|---|---|
| 1st Set | Score | | |
| Khaki | 0 | | |
| Purple Shirt | 0 | | |
| Pink Pongee (4) | 0 | Average | 0 |
| 2nd Set | Score | | |
| Khaki | 0 | | |
| Purple Shirt | 0 | | |
| Pink Pongee (4) | 0 | Average | 0 |

EXAMPLE 2

An inventive fabric treatment article was prepared from a nonwoven cloth made of 70% rayon/30% polyester and compared to a comparative article of 100% polyester, 20×28 cm in dimension. Both nonwoven sheets were dosed with 25 g of the following fabric treatment composition by pipette:

1.6% fragrance oil
0.2% sodium citrate dihydrate
7.5 ppm preservative (Kathon CG/ICP II)
Deionized water to 100%

It was observed that the inventive sheet of 70% rayon/30% polyester absorbed the fabric treatment composition quickly and completely. The comparative 100% polyester sheet did not absorb the entire quantity of the fabric treatment composition; rather, the fabric treatment composition remained in discrete droplets on the sheet surface and was easily shed and was not absorbed. This is disadvantageous since the fabric treatment article needs to absorb the fabric treatment composition in order to effectively transfer the fabric treatment composition and deliver the fragrance's freshening benefits to the fabrics when the fabric treatment composition is later released in the tumble dryer.

EXAMPLE 3

Inventive and comparative fabric treatment articles were prepared from nonwoven cloth composed of 70% rayon/30% polyester. The inventive article was dosed with 25 g and the comparative article was dosed with 200 g, respectively, of the following fabric treatment composition by pipette:

1.6% fragrance oil
0.2% sodium citrate dihydrate
7.5 ppm preservative (Kathon CG/ICP II)
Deionized water to 100%

Sufficient nonwoven material was used to absorb the liquid completely for both the inventive and comparative cases. For the 25 g case (inventive), the article dimension was 20×28 cm. For the 200 g case (comparative), the articles dimension was 20×224 cm. The 200 g article was folded and fastened to the same dimension as the 25 g article (20×28 cm) to simulate more convenient consumer usage and less likelihood of entanglement with garments to be treated in the tumble dryer.

The articles were dried in a Kenmore tumble dryer (Model 110.60992990) with 6 pounds of 100% cotton ballast sheets under medium heat (70° C.) for 20 minutes. The inventive article was completely dry after 20 minutes. The folded comparative article was still damp, indicating that not all of the fabric treatment composition had been delivered. This indicates that usage of such a large quantity of fluid can take longer to dry, thus being less convenient for consumers to use.

EXAMPLE 4

Nonwoven fabric made of several different hydrophobic/hydrophilic fiber compositions as described below were dosed with the following fabric treatment composition, by pipette:

1.6% fragrance oil
0,2% sodium citrate dihydrate
7.5 ppm preservative (Kathon CG/ICP II)
Deionized water to 100%

A 20×28 cm swatch of each of the following was dosed with the maximum amount is of fabric treatment composition each could fully absorb without noticeable dripping:

| SUBSTRATE | MAX. AMT. OF COMPOSITION DOSED |
|---|---|
| 60% polypropylene/40% rayon | 34 g |
| 70% polyester/30% rayon | 20 g |
| 100% polyester | 0 g |
| 70% rayon/30% polyester | 50 g |

This example demonstrates that even relatively low levels of hydrophilic fiber in the nonwoven will improve absorptive properties that are desirable to deliver the fabric treatment composition in the dryer to the fabrics being treated.

EXAMPLE 5

A malodor reduction test for garments was performed using inventive fabric treatment articles composed of nonwoven fabrics treated with the following fabric treatment composition:

1.6% fragrance oil
0.2% sodium citrate dihydrate
7.5 ppm preservative (Kathon CG/ICP II)
Deionized water to 100%

7 g of the liquid fabric treatment composition was dosed onto 20×14.5 cm nonwoven articles of 70% rayon/30% polyester. Separately, two or three prewashed garments were placed in a small odor booth (10 cubic feet). Two lit cigarettes (Marlboro® brand) were placed in the booth. Smoke was allowed to fill the booth for 10 minutes. The test fabric was left in the booth for an additional 5 minutes at a temperature of about 20 to 25° C.

2–3 coded garments were then placed in a clothes dryer with the inventive article. The dryer was run on medium heat (approx. 70° C.) for 15 minutes. A panel of 20 trained and untrained evaluators smelled the garments immediately after the end of the dryer cycle and 12–24 hours later. In addition, garments exposed to malodor but not treated with the nonwoven article were evaluated for odor as a control.

The panelists evaluated the odors using the Labelled Magnitude Scale (LMS) (Green, et al., Chemical Senses 21(3), 323–334 (1996)), a nonlinear scale from 0 to 100, where 0 represents no malodor and 100 represents the strongest possible malodor. The geometric mean of the scores of the panelists are used to rate the malodor before and after treatment. The results are summarized below:

| | Out of Dryer | 12–24 hrs. later |
|---|---|---|
| No treatment | 49.88 | 38.86 |
| Treatment with nonwoven | 4.82 | 4.85 |

On the LMS scale, the malodor scores without treatment are considered "strong"; the ones after treatment are considered "weak". The inventive article was therefore shown to be successful in reduction of malodor.

EXAMPLE 6

Two identical 100% silk blouses were treated with inventive and comparative fabric treatment articles containing the following fabric treatment compositions:

1.6% fragrance oil
0.2% sodium citrate dihydrate
7.5 ppm preservative (Kathon CG/ICP II)
Deionized water to 100%

The nonwoven used was composed of a 70% rayon/30% polyester blend.The inventive treatment article contained 25 g of the above fabric treatment composition; its dimensions were 20×28 cm. The comparative treatment article contained 200 g of the fabric treatment composition; its dimensions were 20×224 cm; this article was then folded to a dimension of 20×28 cm and fastened so as to maintain these dimensions. Each treatment article was placed in a tumble dryer with one silk blouse; the dryer was then run for 20 minutes at medium heat (70° C.). After 20 minutes, the blouses were evaluated for water spotting on a scale from 0 to 5 using the above Spotting Method, with 0=no spotting and 5=heavy spotting.

Results:

The blouse treated with the inventive treatment article with 25 g of the fabric treatment composition resulted in a spotting score of 2.0 (little spotting). The blouse treated with the comparative treatment article with 200 g of the fabric treatment composition resulted in a spotting score of 5 (heavy spotting). Thus, the comparative treatment article containing 200 g of the fabric treatment composition increases spotting of garments susceptible to water damage over the treatment article of the present invention.

What is claimed is:

1. A substantially wet fabric treatment article for treating fabrics in a rotary tumble dryer, comprising:

a. a treatment article substrate having a hydrophobic and a hydrophilic segment wherein said hydrophobic segment has a capacity to releasably absorb a quantity of an oil and said hydrophilic segment has a capacity to releasably absorb a quantity of water;

b. a fabric treatment liquid or gel composition releasably absorbed on said substrate, said composition containing at least 50% by wt. of water based on said composition;

c. a fabric treatment component wherein said fabric treatment component does not demonstrate visually perceivable staining of the treated fabrics under standard tumble drying conditions;

d. less than 1.0% by wt. of a surfactant, a dispersing agent, a cationic fabric softener or a blend thereof based on the weight of said composition, and less than 2% by wt. of non-volatile matter; and e. wherein said treatment article contains said fabric treatment composition in an amount of 1.0 grams to less than 190 grams; and, f. wherein said fabric treatment composition contains about 0.5 to 5% by wt. of a fragrance.

2. The article of claim 1, wherein the ratio of said hydrophobic capacity to absorb oil to said hydrophilic capacity to absorb water is in the range of 99:1 to 1:99.

3. The article of claim 1, wherein said substrate is a nonwoven textile having at least one layer.

4. The article of claim 3 wherein said nonwoven textile contains fibers with hydrophilic surfaces and fibers with hydrophobic surfaces in the same layer or in different layers.

5. The article of claim 4 wherein said nonwoven textile contains a blend of rayon and polyester fibers in the ratio range of 1:99 to 99:1.

6. The article of claim 1, wherein at least one of said fabric treatment components is a fragrance and has a volatility such that organoleptically perceivable fragrance and/or absence of malodor is delivered to the treated fabrics upon treatment in a rotary tumble dryer under standard tumble drying conditions.

7. The article of claim 1, wherein the fabric treatment composition further comprises a buffering agent.

8. A method of treating fabrics to remove odors and/or wrinkles without leaving a visible product residue, comprising the steps of:

a. contacting a fabric or garment with an treatment article substrate; and b. agitating the fabric or garment and substrate in a drying apparatus under conditions effective for delivering the major portion of said fabric treatment composition to the treated articles for a time period of 1 to 45 minutes, wherein the fabric or garment and substrate is allowed to directly contact the inner surface of the dryer while running the drying apparatus, and wherein the treatment does not leave a visible residue on the fabric or garment.

9. A process for manufacturing the article of claim 1, where the fragrance is applied to the substrate in a separate step from the water by spraying, coating or dipping.

10. A process for manufacturing the article of claim 1, where the fragrance and fabric treatment composition are continuously homogenized until transfer to a spraying, coating or dipping device; the homogenized composition containing at least 50% by wt. of droplets with a diameter below 50 microns, said composition being applied to said substrate within 5 minutes after the transfer by spraying, coating or dipping.

* * * * *